United States Patent [19]

Boyer

[11] Patent Number: 4,620,522

[45] Date of Patent: Nov. 4, 1986

[54] IGNITION DISTRIBUTOR VOLTAGE GENERATOR

[76] Inventor: James A. Boyer, R.R. 2, Box 240-B, Anderson, Ind. 46011

[21] Appl. No.: 786,367

[22] Filed: Oct. 11, 1985

Related U.S. Application Data

[63] Continuation of Ser. No. 649,196, Sep. 10, 1984, abandoned.

[51] Int. Cl.[4] ..... F02P 9/00

[52] U.S. Cl. ..... 123/617; 123/633; 307/354; 310/70 R

[58] Field of Search ..... 123/617, 633, 612, 618, 123/146.5 A; 307/354, 357; 310/70 R

[56] References Cited

U.S. PATENT DOCUMENTS

| | | | |
|---|---|---|---|
| 2,071,573 | 2/1937 | Randolph et al. | 123/617 |
| 3,060,346 | 10/1962 | Sohner | 123/617 |
| 3,219,878 | 11/1965 | Konopa | 123/617 |
| 3,254,247 | 11/1962 | Falge | 310/70 R |
| 3,434,462 | 3/1969 | Schneider et al. | 123/617 |
| 3,473,061 | 10/1969 | Soehner et al. | 310/70 R |
| 3,888,225 | 6/1975 | Boyer et al. | 123/617 |
| 3,955,550 | 5/1976 | Carlsson | 123/617 |
| 4,078,534 | 3/1978 | Mayer | 123/133 |
| 4,129,107 | 12/1978 | Bayer | 123/617 |
| 4,153,850 | 5/1979 | Boyer | 307/354 |
| 4,165,726 | 8/1979 | Helmer | 123/146.5 A |
| 4,191,155 | 3/1980 | Nishio et al. | 123/633 |

*Primary Examiner*—Raymond A. Nelli

[57] ABSTRACT

A voltage generating ignition distributor for an internal combustion engine that has a pickup coil and a magnetic rotor. In order to prevent high frequency voltages, developed at the gap between the rotor contact and the outer electrodes of the distributor cap, from distorting the voltage generated in the pickup coil the outer turns of the pickup coil are grounded through a capacitance. The outer turns of the pickup coil thus form a grounded shield for the inner turns of the pickup coil at the high frequency of the voltage at the rotor gap discharge.

4 Claims, 3 Drawing Figures

IGNITION DISTRIBUTOR VOLTAGE GENERATOR

This is a continuation of application Ser. No. 649,196, filed on Sept. 10, 1984, now abandoned.

This invention relates to a voltage generating ignition distributor for providing a generated voltage the shape of which varies as a function of the rotary position of a rotatable shaft and more particularly to a voltage generator for controlling ignition timing and electronic fuel injection apparatus of an internal combustion engine.

Voltage generating devices of the magnetic pickup type, which are part of an ignition distributor, are well known to those skilled in the art, examples being the devices disclosed in the U.S. Pat. Nos. to Fale 3,254,247 and to Boyer 3,888,225. The voltage generators disclosed in these patents utilize a permanent magnet, a magnetic rotor and an annular pickup coil disposed about the shaft, the coil being concentric with the shaft.

In the use of voltage generating ignition distributors, of the type described, the pickup coil is subjected to capacitive electric field coupling from the arc discharge between the conductive insert of the distributor rotor and the outer electrodes of the distributor cap. This capacitive electric field coupling can cause the voltage generated in the pickup coil to be distorted and this can cause improper spark timing and improper timing of fuel injection where the voltage generated in the pickup coil is used to control ignition timing and fuel injection.

One method of preventing capacitive electric field coupling to the pickup coil is disclosed in my copending patent application Ser. No. 518,670, filed on July 29, 1983 now U.S. Pat. No. 4,485,796, granted on Dec. 4, 1984 and assigned to the assignee of this invention. In that patent a steel plate, which is electrically grounded, extends across the top end of the pickup coil to form an electrostatic shield.

The steel plate approach, that has just been described, is effective to prevent capacitive electric field coupling to the top end of the pickup coil but it will not prevent capacitive electric field coupling to the outer circumferentially extending turns of the pickup coil.

It accordingly is an object of this invention to provide a voltage generating ignition distributor that has a pickup coil that is so wound and so electrically connected to ground as to prevent capacitive electric field coupling to the outer turns of the coil from distorting the voltage generated in the coil. In carrying this object forward the terminating lead that is connected to the outer turns of the pickup coil is connected to ground through a capacitor. With this arrangement the outer turns of the pickup coil are effectively grounded for the high frequency discharge that occurs at the distributor rotor gap and the outer turns form a grounded shield for the inner turns of the pickup coil.

IN THE DRAWINGS

Figure 1:
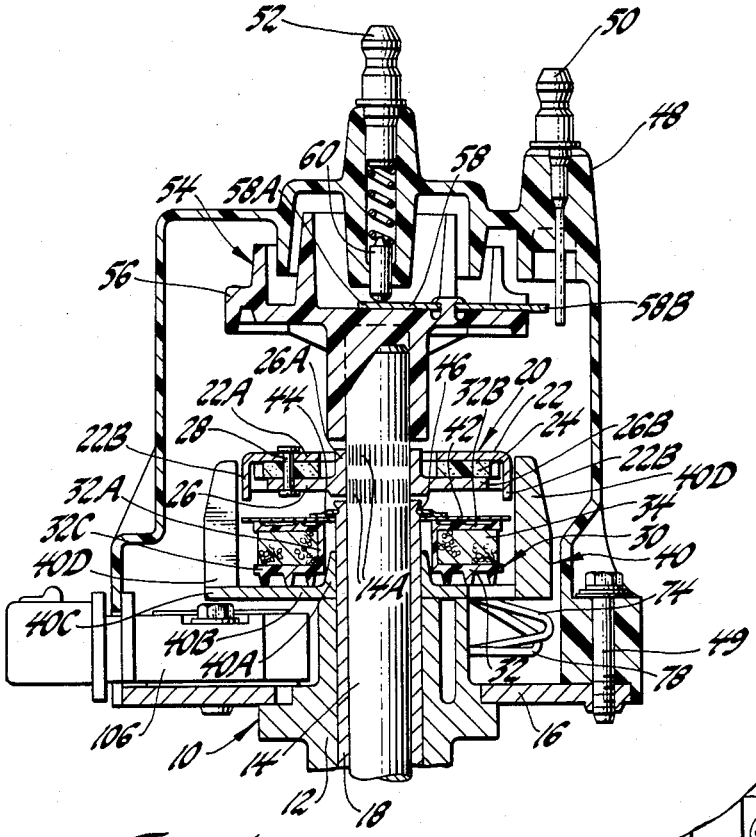
FIG. 1 is a sectional view of an ignition distributor made in accordance with this invention.

Referring now to the drawings and more particularly to FIG. 1, the reference numeral 10 generally designates a base assembly for an ignition distributor. The base assembly 10 has an axially extending part 12 provided with a bore that receives a distributor shaft 14 which is formed of steel. The base 10 includes a laterally extending plate member 16 which is secured to the part 12. The part 12 and plate member 16 are formed of aluminum material and plate member 16 is secured to part 12 by a staking operation.

A tubular sleeve bearing 18 which is formed, for example, of a sintered iron and bronze composition, for example 60% iron and 40% bronze, is press-fitted to the bore of part 12 and rotatably supports the upper end of the distributor shaft 14. The lower end of the shaft 14 is rotatably supported in another sleeve bearing (not illustrated) which is disposed in the bore of part 12 at a position adjacent the lower end thereof in a manner well known to those skilled in the art.

The shaft 14 drives a magnetic rotor generally designated by reference numeral 20. The rotor 20 comprises a steel pole plate 22, an annular washer-shaped permanent magnet 24 and a rotor part 26. The rotor part 26 is formed of a magnetic material such as sintered iron and has a hub portion 26A and to an annular plate portion 26B. The pole plate 22 has an annular portion 22A and a plurality of integral downwardly bent portions 22B that form pole teeth for the rotor. The pole plate 22, permanent magnet 24 and rotor part 26 are secured together by a plurality of rivets 28 which are formed of a nonmagnetic material such as stainless steel. The rivets 28 extend through holes formed in the permanent magnet 24, pole plate 22 and plate portion 26B of part 26.

The permanent magnet 24 is formed of thermoplastic material which is filled with a powdered magnetic material such as berrium ferrite. The permanent magnet 24 is axially magnetized such that its upper and lower faces, that respectively engage parts 22 and 26, have opposite magnetic polarities. The rotor 20 is secured to the shaft 14 by staking portions of the hub portion 26A to the splined portions 14A of shaft 14.

The voltage generating portion of the ignition distributor of this invention has a coil winding assembly generally designated by reference numeral 30. The coil winding assembly 30 comprises a coil form or spool 32 that is formed of electrical insulating material. The spool 32 has an inner annular portion 32A upon which is wound a pickup coil 34. The spool 32 further has annular portions 32B and 32C which, together with the outer surface of annular wall portion 32A, form a winding space that contains the pickup coil 34. The manner in which the pickup coil 34 is wound will be described in detail hereinafter in connection with FIG. 3.

The voltage generator of the ignition distributor of this invention has a pole piece generally designated by reference numeral 40 which is formed of a magnetic material such as steel. The pole piece 40 has an annular portion 40A which engages the outer periphery of bearing sleeve 18 and has a laterally extending portion 40B which merges into arms 40C. Extending upwardly from the arms 40C are a plurality of pole teeth 40D. The width of the pole teeth 40D is approximately equal to the width of the pole teeth 22B and in one position of the rotor 20 the pole teeth 22B are exactly aligned with the upper end of the pole teeth 40D.

The coil winding assembly 30 is supported by the portion 40B of pole piece 40. A thin (0.016 inches) copper plate 42 engages the wall portion 32B of the coil winding assembly 30. The annular copper plate 42 is disposed about the upper end of bearing 18. The outer periphery of the copper plate 42 is located adjacent inner edges of the pole teeth 40D. The copper plate 42 and the coil winding assembly 30 are forced against the portion 40B of pole plate 40 by a spring metal fastener 44 having portions disposed within a groove 46 formed in the upper end of bearing 18. The fastener 44 has outer portions engaging the copper plate 42 and the fastener is axially stressed in order to apply an axial force to the copper plate 42 and the coil winding assembly 30 in order to clamp these parts between the fastener and the laterally extending portion 40B of pole plate 40.

The portion 40B of the pole plate 40 has downwardly extending bosses (not illustrated) which are engaged with flat walls formed on the upper end of portion 12 of the base 10 to provide proper orientation for pole plate 40 when it is assembled to the end of portion 12 of base 10. These bosses and flat surfaces are illustrated in the above-referenced copending patent application Ser. No. 518,670. The pole plate 40 is secured to base 10 in such a fashion as to prevent rotation of pole plate 40 relative to base 10. This can be accomplished by a steel pin which is press-fitted to a hole in the pole plate and to an aligned bore formed in base 10. The portion 32C of spool 32 has a downwardly projecting post that fits within an opening formed in the pole plate 40 to prevent rotation of the spool 32 relative to the pole plate.

The ignition distributor of this invention has a distributor cap 48 which is formed of insulating material and which is secured to base plate 16 by screws 49. The distributor cap 48 has a plurality of circumferentially spaced outer electrodes 50 and a center electrode 52. Electrode 52 is adapted to be connected to the secondary winding of an ignition coil while the electrodes 50 are adapted to be connected respectively to the spark plugs of an internal combustion engine. The electrode 52 and the electrodes 50 are periodically electrically connected by a distributor rotor generally designated by reference numeral 54. The rotor 54 comprises a part 56 formed of insulating material which carries a metallic current conducting segment or rotor contact 58. The segment 58 has a portion 58A that engages a conductive spring biased brush 60 that is electrically connected to the electrode 52. The outer end 58B of segment 58 swings past lower inner portions of the output electrodes 50 in manner well known to those skilled in the art to sequentially connect the secondary winding of the ignition coil to the spark plugs. The rotor 54 is connected to the top end of the distributor shaft 14 so as to be rotatably driven thereby, as illustrated in FIG. 1.

The pickup coil is formed of a thin diameter insulated wire, for example #38 AWG insulated copper wire which has a diameter of approximately 0.1 mm. By way of example and not by way of limitation, the winding 34 may be comprised of approximately 4000 turns of wire. The wire is wound in the winding space of the spool and is wound in what may be termed a random layer winding. That is, the wires are wound in layers but no attempt is made to individually line up respective turns to form a layer of aligned wires. Assuming for example, that the dimension between the inner surfaces of walls 32B and 32C of the spool 32 is approximately 5.6 mm, it can be appreciated that each layer of wires, although not exactly aligned, may consist of approximately 56 turns.

Figure 3:
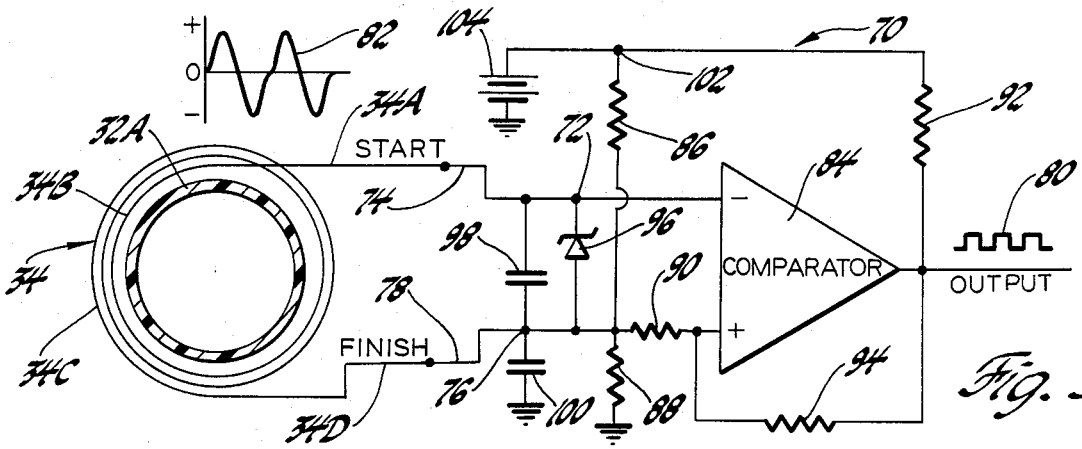
FIG. 3 illustrates schematically the method of winding the pickup coil for the voltage generating ignition distributor of this invention and how the pickup coil is connected with an electronic squaring circuit.

The method of winding the coil 34 and the connection of the end leads of this coil with an electronic squaring circuit is illustrated in FIG. 3. In FIG. 3 the annular portion of the spool 32 is again designated by reference numeral 32A. In winding the wire on the spool a start lead 34A is provided and during beginning of the winding, the start lead, is applied directly to the outer periphery of the spool portion 32A. In FIG. 3 the inner turns of the coil winding are designated by reference numeral 34B it being understood that there will be multiple inner turns of fine wire. As the winding proceeds, the turns build up radially outward and the outer turns of the winding have been designated by reference numeral 34C and these outer turns are connected to a finish lead 34D. As with the case of the inner turns, the single outer turn 34C is intended to represent numerous outer turns that axially fill the winding space in the spool and, of course in effect, form a sheath of wires.

The start lead wire 34A of the coil winding 34 is connected to an input junction 72 of an electronic squaring circuit 70 by a lead 74 which is of heavier wire than the wire that forms the coil winding. The finish lead 34D is connected to the input junction 76 of the electronic squaring circuit by a lead 78 which again is of heavier wire than the wire that forms the coil winding.

The leads 74 and 78 form inputs to the electronic squaring circuit 70 and this circuit performs the function of developing a square wave voltage 80 from the alternating voltage 82 generated in the pickup coil 34. The electronic squaring circuit 70 is the same as that disclosed in the U.S. Pat. No. to Boyer 4,153,850. Thus, circuit 70 comprises a comparator 84, resistors 86, 88, 90, 92 and 94, a Zener diode 96 and capacitors 98 and 100, all connected as illustrated in FIG. 3. The junction 102 of circuit 70 is connected to the positive side of a direct voltage source which is illustrated as motor vehicle battery 104. The negative side of battery 104 is connected to ground. The capacitor 100 is connected between junction 76 and ground and it may have a capacitance of approximately 680 picofarads. The operation of circuit 70 is as described in the above-referenced U.S. Pat. No. 4,153,850.

When the distributor is in operation there is a high frequency discharge at the rotor gap between the end 58B of rotor conductor 58 and the lower end of the outer electrodes 50. This high frequency voltage will be capacitively coupled to the outer turns 34C of the pickup coil 34. This does not cause a distortion of the voltage generated in pickup coil 34, however, because the terminating lead 34D of the outer turns 34C is effectively grounded at high frequencies through capacitor 100. Thus, the capacitor 100 has a low reactance or impedance at high frequencies and hence the high frequency voltage is directed to motor vehicle ground. Moreover, the coil 34, being an inductance, has a reactance or impedance that increases with increasing frequency.

Since the inner turns 34B of pickup coil 34 are buried in the outer turns 34C, the outer turns form a grounded shield for the inner turns. This prevents capacitive coupling of the high frequency rotor gap discharge to the inner turns 34B. It should be noted that with the circuit illustrated in FIG. 3, and assuming that pickup coil 34 was wound such that turns 34B were the outer turns of the coil rather than the inner turns, voltage generated in the coil 34 would be distorted by the high frequency rotor gap discharge. With such a hypothetical arrangement the high impedance of coil 34 would prevent the high frequency discharge from being passed to ground by capacitor 100.

In regard to the generation of the voltage in the pickup coil, as rotor 20 rotates it will be appreciated that the permanent magnet causes a flow of flux through a flux path that links the pickup coil 34. This flux path may be traced, for example, from the upper surface of permanent magnet 24 to pole plate 22, through the air gap between the pole teeth 22B to pole teeth 40D, through the pole teeth 40D to the portions 40B and 40A of the pole plate 40 and then back to the opposite side of the permanent magnet 24 via bearing 18, shaft 14 and part 26. As the rotor rotates the reluctance of this flux path varies causing variations in flux flow and accordingly an alternating voltage 82 is generated in the pickup coil 34 which is a function of the rotative position of the shaft 14.

The purpose of the metallic copper plate 42 is to prevent stray electromagnetic fields from inducing voltages in the pickup coil 34 that might distort its output voltage. Thus, any electromagnetic field that cuts the washer-shaped metallic plate 42 induces a current therein since the plate 42 is essentially a shorted turn. The current induced in the plate 42 develops a field which opposes the electromagnetic field.

In regard to preventing the capacitive coupling of the electric field developed by the rotor gap discharge, it has been pointed out that the coil winding is wound to prevent such discharge from distorting the voltage generated in the pickup coil 34. This capacitive electric field coupling is also prevented from being coupled to the top of the coil winding 34 by the annular portion 22A of the pole plate 22. This annular portion 22A is electrically grounded via rivets 28 and the metallic rotor part 26 so that it in effect provides a grounded shield or ground plane for preventing capacitive electric field coupling from the gap discharge to the top end of the pickup coil 34. The primary function of the metallic plate 42 is to prevent stray electromagnetic fields from distorting the generated voltage but it also, to some extent, prevents capacitive electric field coupling to the top end of pickup coil 34 since it is also electrically grounded via the fastener 44.

The shaft 14, of the voltage generating ignition distributor, is adapted to be driven by the camshaft of an internal combustion engine and the voltage generated in the pickup coil 34 and the edges of the square wave voltage 80, illustrated in FIG. 3, therefore represent and are a function of engine crankshaft position. The square wave voltage 80 is utilized to control ignition spark timing and is also utilized to control the timing of the fuel injectors of an electronic fuel injection system, which has not been illustrated. It therefore is important that the voltage generated in the pickup coil 34 not be distorted by either stray electromagnetic fields nor by the high frequency voltage generated at the rotor gap and capacitively coupled to the pickup coil. The voltage generating device of this invention, as described, prevents distortion of the voltage generated in the pickup coil due to either stray electromagnetic fields or the capacitive coupling to the pickup coil from the rotor gap discharge.

Figure 2:
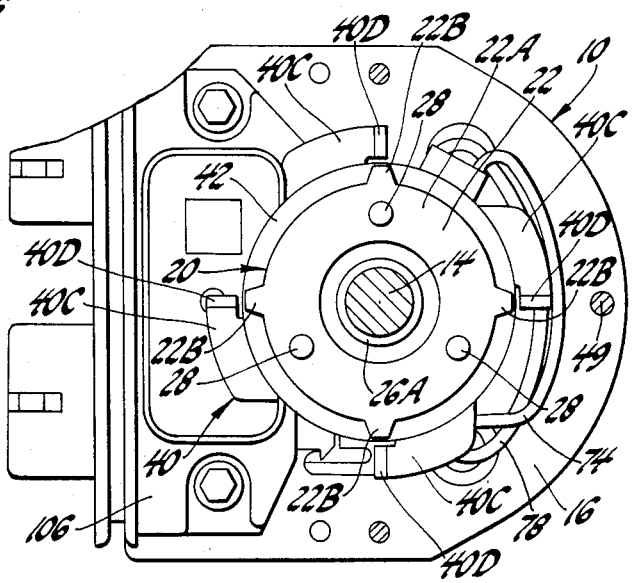
FIG. 2 is an end view of the distributor shown in FIG. 1 with the distributor cap removed.

The squaring circuit 70 forms part of an electronic module 106 which is supported by the base of the distributor. It is connected to pickup coil 34 by the leads 74 and 78 which are illustrated in FIGS. 1–3.

The electronic squaring circuit 70 can take forms other than the one illustrated in FIG. 3 as long as it is capable of developing a square wave output voltage 80 from an alternating input voltage 82. The circuit must, however, have a capacitor, like capacitor 100, which connects the outer turns of the pickup coil to ground. Thus, regardless of the electronic circuit utilized, the outer turns of the pickup coil must be effectively grounded at the high frequency of the rotor gap discharge voltage.

When the distributor is assembled to an engine the base 10 engages the engine and hence is electrically grounded to motor vehicle ground.

The embodiments of the invention in which an exclusive property or privilege is claimed are defined as follows:

1. A voltage pulse generator and ignition distributor comprising, a base, a shaft rotatably supported by said base, a distributor cap supported by said base having a center electrode and a plurality of circumferentially spaced outer electrodes, a first rotor driven by said shaft formed of electrical insulating material having electrically conductive means connected to said center terminal and a portion that rotates past said outer electrodes, the portion of said electrically conductive means that rotates past said outer electrodes being spaced from said outer electrodes to form a gap therebetween, a voltage pulse generator comprising, a second rotor driven by said shaft, at least one permanent magnet and an annular pickup coil supported by said base, said pickup coil having a plurality of inner turns and a plurality of outer turns, the beginning turn of said inner turns connected to a first lead and the last turn of said outer turns connected to a second lead, said outer turns enclosing said inner turns, and a circuit connected directly between said second lead and ground which is operative to provide a direct conductive path to ground for high frequency energy capacitively coupled to said outer turns from the gap discharge between said electrically conductive means of said first rotor and an outer electrode, said outer turns forming a grounded shield for said inner turns.

2. A voltage generator and ignition distributor for an internal combustion engine comprising, a base, a shaft rotatably supported by said base, a distributor cap supported by said base having a center electrode and a plurality of outer electrodes, a first rotor formed of insulating material driven by said shaft carrying conductor means electrically connected to said center terminal, said conductor means having a surface that is periodically aligned with a portion of said outer electrodes as said first rotor rotates, said surface being spaced from said portions of said outer electrodes to provide a rotor gap therebetween, an annular pickup coil supported by said base and disposed about said shaft, means for causing a voltage to be induced in said pickup coil when said shaft is rotated comprising at least one permanent magnet and a second rotor formed of metallic magnetic material, said second rotor having a wall that extends laterally across one end of said pickup coil which is positioned between said pickup coil and said rotor gap, said second rotor electrically connected to said base, said pickup coil having a plurality of inner turns and a plurality of outer turns, the beginning turn of said inner turns connected to a first lead and the last turn of said outer turns connected to a second lead, said outer turns enclosing said inner turns, and a capacitor one side of which is directly connected to said second lead by a conductor and the opposite side of which is directly connected to ground by a conductor, said capacitor forming a direct conductive path to ground for high frequency energy capacitively coupled to said outer turns from the gap discharge at said rotor gap, said outer turns forming a grounded shield for said inner turns.

3. A voltage generator and ignition distributor for an internal combustion engine comprising, a base, a shaft rotatably supported by said base, a distributor cap supported by said base having a center electrode and a plurality of outer electrodes, a first rotor formed of insulating material driven by said shaft carrying conductor means electrically connected to said center terminal, said conductor means having a surface that is periodically aligned with a portion of said outer electrodes as said first rotor rotates, said surface being spaced from said portions of said outer electrodes to provide a rotor gap therebetween, an annular pickup coil supported by said base and disposed about said shaft, means for causing a voltage to be induced in said pickup coil when said shaft is rotated comprising at least one permanent magnet and a second rotor formed of metallic magnetic material, said second rotor having a wall that extends laterally across one end of said pickup coil which is positioned between said pickup coil and said rotor gap, said second rotor electrically connected to said base, a metallic plate disposed about said shaft extending across said one end of said pickup coil located between said second rotor and said one end of said pickup coil, said pickup coil having a plurality of inner turns and a plurality of outer turns, the beginning turn of said inner turns connected to a first lead and the last turn of said outer turns connected to a second lead, said outer turns enclosing said inner turns, and a capacitor one side of which is directly connected to said second lead by a conductor and the opposite side of which is directly connected to ground by a conductor, said capacitor forming a direct conductive path to ground for high frequency energy capacitively coupled to said outer turns from the gap discharge at said rotor gap, said outer turns forming a grounded shield for said inner turns.

4. A voltage generator and ignition distributor for an internal combustion engine comprising, a base, a shaft rotatably supported by said base, a distributor cap supported by said base having a center electrode and a plurality of outer electrodes, a first rotor formed of insulating material driven by said shaft carrying conductor means electrically connected to said center terminal, said conductor means having a surface that is periodically aligned with a portion of said outer electrodes as said first rotor rotates, said surface being spaced from said portions of said outer electrodes to provide a rotor gap therebetween, an annular pickup coil supported by said base and disposed about said shaft, means for causing a voltage to be induced in said pickup coil when said shaft is rotated comprising a second magnetic rotor and a pole plate, said second rotor having a plate member formed of magnetic material that has circumferentially spaced pole teeth, a rotor part formed of magnetic material fixed to said shaft, a permanent magnet disposed between and engaging said plate member and said rotor part, the opposite end faces of which are of opposite magnetic polarity, said pole plate supporting said pickup coil and having axially extending pole teeth located outside of said pickup coil that become periodically aligned with the pole teeth of said plate member when said second rotor rotates, said pickup coil having a plurality of inner turns and a plurality of outer turns, the beginning turn of said inner turns connected to a first lead and the last turn of said outer turns connected to a second lead, said outer turns enclosing said inner turns, and a capacitor one side of which is directly connected to said second lead by a conductor and the opposite side of which is directly connected to ground by a conductor, said capacitor forming a direct conductive path to ground for high frequency energy capacitively coupled to said outer turns from the gap discharge at said rotor gap, said outer turns forming a grounded shield for said inner turns.

* * * * *